US009636808B2

(12) United States Patent
Ho

(10) Patent No.: US 9,636,808 B2
(45) Date of Patent: May 2, 2017

(54) IMPACT DEVICE OF PNEUMATIC TOOL

(71) Applicant: Chuan-Cheng Ho, Taichung (TW)

(72) Inventor: Chuan-Cheng Ho, Taichung (TW)

( * ) Notice: Subject to any disclaimer, the term of this patent is extended or adjusted under 35 U.S.C. 154(b) by 438 days.

(21) Appl. No.: 14/530,271

(22) Filed: Oct. 31, 2014

(65) Prior Publication Data

US 2015/0114674 A1 Apr. 30, 2015

(30) Foreign Application Priority Data

Oct. 31, 2013 (TW) ..... 102139619 A

(51) Int. Cl.
*B25B 21/02* (2006.01)
*B25B 19/00* (2006.01)
*B25B 23/145* (2006.01)

(52) U.S. Cl.
CPC ..... *B25B 19/00* (2013.01); *B25B 21/02* (2013.01); *B25B 21/026* (2013.01); *B25B 23/1453* (2013.01)

(58) Field of Classification Search
CPC ..... B25B 21/02; B25B 21/026; B25B 19/00; B25B 23/1453
USPC ..... 173/93, 93.5, 93.6, 104, 128, 206, 218, 173/168; 464/25, 26, 28
See application file for complete search history.

(56) References Cited

U.S. PATENT DOCUMENTS 3,228,486 A * 1/1966 Kaman ..... B25B 21/02 173/93.6
3,789,934 A * 2/1974 Schoeps ..... B25B 21/026 173/93.5
4,533,337 A * 8/1985 Schoeps ..... B25B 21/026 173/93
4,557,337 A * 12/1985 Shibata ..... B25B 21/026 173/93
4,683,961 A * 8/1987 Schoeps ..... B25B 21/02 173/93
4,735,595 A * 4/1988 Schoeps ..... B25B 21/02 173/93
4,767,379 A * 8/1988 Schoeps ..... B25B 21/02 173/93.5
4,836,296 A * 6/1989 Biek ..... B25B 23/1453 173/93.5
5,622,230 A * 4/1997 Giardino ..... B25B 21/02 173/93

(Continued)

*Primary Examiner* — Scott A. Smith

(74) *Attorney, Agent, or Firm* — Muncy, Geissler, Olds & Lowe, P.C.

(57) ABSTRACT

An impact device includes a transmission shaft, an impact cylinder, two first impact pins and a first ring. The transmission shaft has an impacted section disposed in the impact cylinder, an extending section extending along an axis, a first protrusion extending toward a first radial direction, and two first concave surfaces located at the first protrusion. The impact cylinder has two elongated protrusions and two first radial holes separated by the elongated protrusions. The first impact pins are received in the first radial holes in parallel to the axis and abuttable against the first concave surfaces. The first ring is sleeved onto the impact cylinder and the first impact pins and has a first narrow groove in which one elongated protrusion is located, and a first wide groove in which the other elongated protrusion is movably located. The impact device has sufficient torque output and long lifetime.

5 Claims, 12 Drawing Sheets

(56) References Cited

U.S. PATENT DOCUMENTS

| | | | | |
|---|---|---|---|---|
| 5,704,434 | A * | 1/1998 | Schoeps | B25B 23/1453 173/168 |
| 5,813,478 | A * | 9/1998 | Kettner | B25B 23/1453 173/218 |
| 6,110,045 | A * | 8/2000 | Schoeps | B25B 21/02 173/93.5 |
| 6,334,494 | B1 * | 1/2002 | Nagato | B25B 23/1453 173/177 |
| 6,446,735 | B1 * | 9/2002 | Chen | B25B 21/02 173/93 |
| 6,983,808 | B1 * | 1/2006 | Chen | B25B 21/02 173/93 |
| 7,438,140 | B2 * | 10/2008 | Sterling | B25B 21/02 173/104 |
| 8,141,654 | B2 * | 3/2012 | Lin | B25B 21/02 173/104 |
| 2005/0023016 | A1 * | 2/2005 | Nakamizo | B25B 23/1453 173/93.5 |
| 2009/0065229 | A1 * | 3/2009 | Uemura | B25B 21/02 173/93.5 |

* cited by examiner

IMPACT DEVICE OF PNEUMATIC TOOL

BACKGROUND OF THE INVENTION

1. Field of the Invention

The present invention relates generally to pneumatic tools, e.g. pneumatic wrench, and more particularly, to an impact device of a pneumatic tool.

2. Description of the Related Art

A pneumatic wrench primarily comprises a pneumatic motor, a shaft rotationally driven by the pneumatic motor, and a socket disposed at an end of the shaft. The socket is adapted to be sleeved onto a nut or the head of a screw and tighten or loosen the nut or screw when rotating along with the shaft.

Some pneumatic wrenches further comprise an impact mechanism. When the nut or screw is tightened to a certain extent that the rotational torque outputted by the pneumatic motor is no longer capable of driving the shaft to rotate, the impact mechanism can be driven to impact the shaft and thereby instantly increase the rotational torque of the shaft. In this way, the shaft can be driven to rotate at the moment of being impacted and therefore drive the socket to further tighten the nut or screw which is initially tightened, or loosen the nut or screw which is firmly tightened.

Specifically speaking, a conventional impact device 10 of a pneumatic tool, which is shown in FIGS. 1-2, comprises a shaft 11 as aforementioned, an impact cylinder 13 sleeved onto the shaft 11 and provided with two through grooves 12, an outer cylinder 15 sleeved onto the impact cylinder 13 and provided with two recesses 14, and two impact pins 16 respectively located in the through grooves 12 and movable into the recesses 14, respectively. The impact cylinder 13 is adapted to be rotationally driven by a pneumatic motor (not shown) so that the whole impact device 10 is driven to rotate. When the shaft 11 is unrotatable along with the impact cylinder 13, the impact pins 16 can be driven by the impact cylinder 13 and the outer cylinder 15 to impact the concave surfaces 17 of the shaft 11 intermittently so that the shaft 11 can be driven to rotate at the moment of being impacted.

In the aforesaid operating process of the impact device 10, the impact cylinder 13, the outer cylinder 15 and the shaft 11 are coaxial with each other all along, and one of the impact pins 16 is temporarily wedged between the impact cylinder 13 and the outer cylinder 15 as a result of the motion of the impact pins 16 going in and out of the recesses 14, so that the wedged impact pin 16 can impact the shaft 11 intermittently. Such impact device 10 can output sufficient torque; however, the impact device 10 has a relatively shorter lifetime resulted from frequent friction between the elements thereof and large impact forces.

SUMMARY OF THE INVENTION

The present invention has been accomplished in view of the above-noted circumstances. It is an objective of the present invention to provide an impact device of a pneumatic tool, which outputs sufficient torque and has a relatively longer lifetime.

To attain the above objective, the present invention provides an impact device of a pneumatic tool, which comprises a transmission shaft, an impact cylinder, two first impact pins, and a first ring. The transmission shaft has an impacted section, an extending section extending from the impacted section along an axis of the transmission shaft, a first protrusion extending from the impacted section toward a first radial direction, and two first concave surfaces located at two sides of the first protrusion. The impact cylinder is provided at an inside thereof with a passage for accommodating the impacted section of the transmission shaft, at an outside thereof with two elongated protrusions which are located at two opposite sides of the impact cylinder and extend parallel to the axis, and at two other opposite sides thereof with two first radial holes. The first radial holes and the elongated protrusions are alternately arranged along a circumference of the impact cylinder. The first impact pins are respectively received in the first radial holes, shaped as circular columns extending parallel to the axis of the transmission shaft, and abuttable against the first concave surfaces of the transmission shaft. The first ring is sleeved onto the impact cylinder and the first impact pins and provided at an inside thereof with a first narrow groove and a first wide groove both extending parallel to the axis of the transmission shaft. The first wide groove is wider than the first narrow groove. One of the elongated protrusions is located in the first narrow groove. The other elongated protrusion is movably located in the first wide groove.

As a result, when one of the first impact pins is abutted against the first protrusion of the transmission shaft but incapable of driving the transmission shaft to rotate, the first ring can be driven to swing relative to the impact cylinder and the transmission shaft in a way that one of the elongated protrusions of the impact cylinder is unmovably limited in the first narrow groove of the first ring and the other elongated protrusion of the impact cylinder moves in the first wide groove of the first ring. In this way, the first impact pin abutted against the first protrusion can be driven to slide over the first protrusion and therefore the impact cylinder, the first ring and the first impact pins can continue to rotate; in the meanwhile, the other first impact pin is pressed by the first ring toward the transmission shaft so as to impact the first protrusion.

In other words, in the impact device of the present invention, the first ring can be driven to swing from the status of being coaxial with the impact cylinder and the transmission shaft to become eccentric with them and therefore enable one of the first impact pins to impact the transmission shaft intermittently. Such impact device can output sufficient torque from the transmission shaft and has a relatively longer lifetime resulted from less friction between the elements of the impact device than the conventional impact devices.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
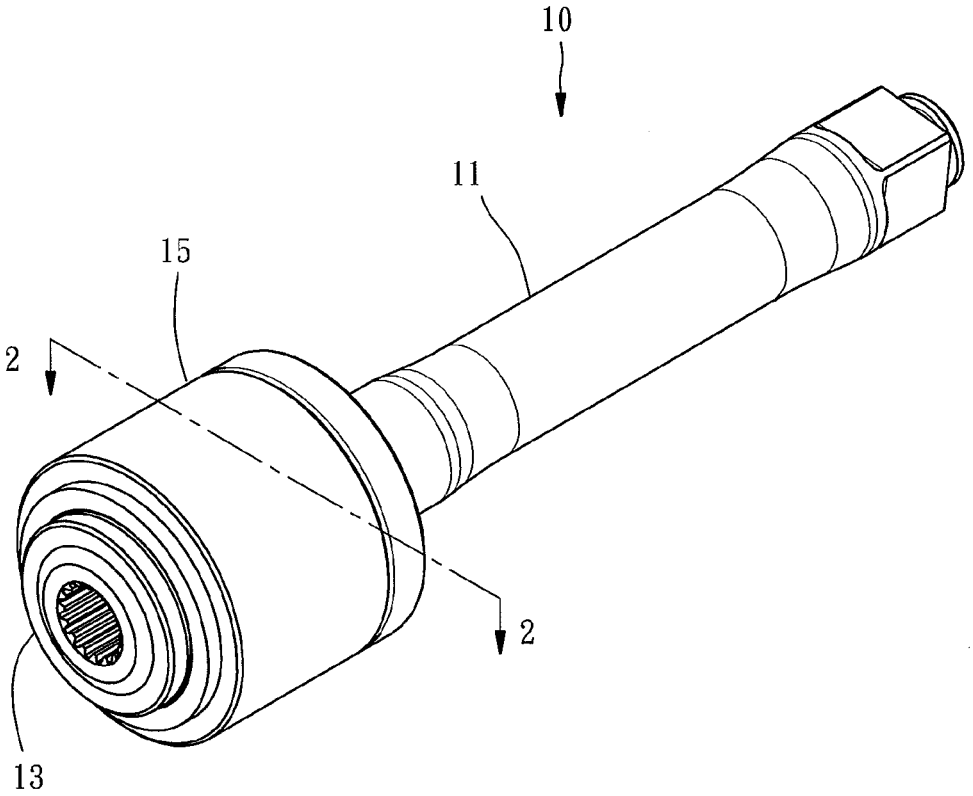
FIG. 1 PRIOR ART
FIG. 1 is an assembled perspective view of a conventional impact device of a pneumatic tool.
Figure 2:
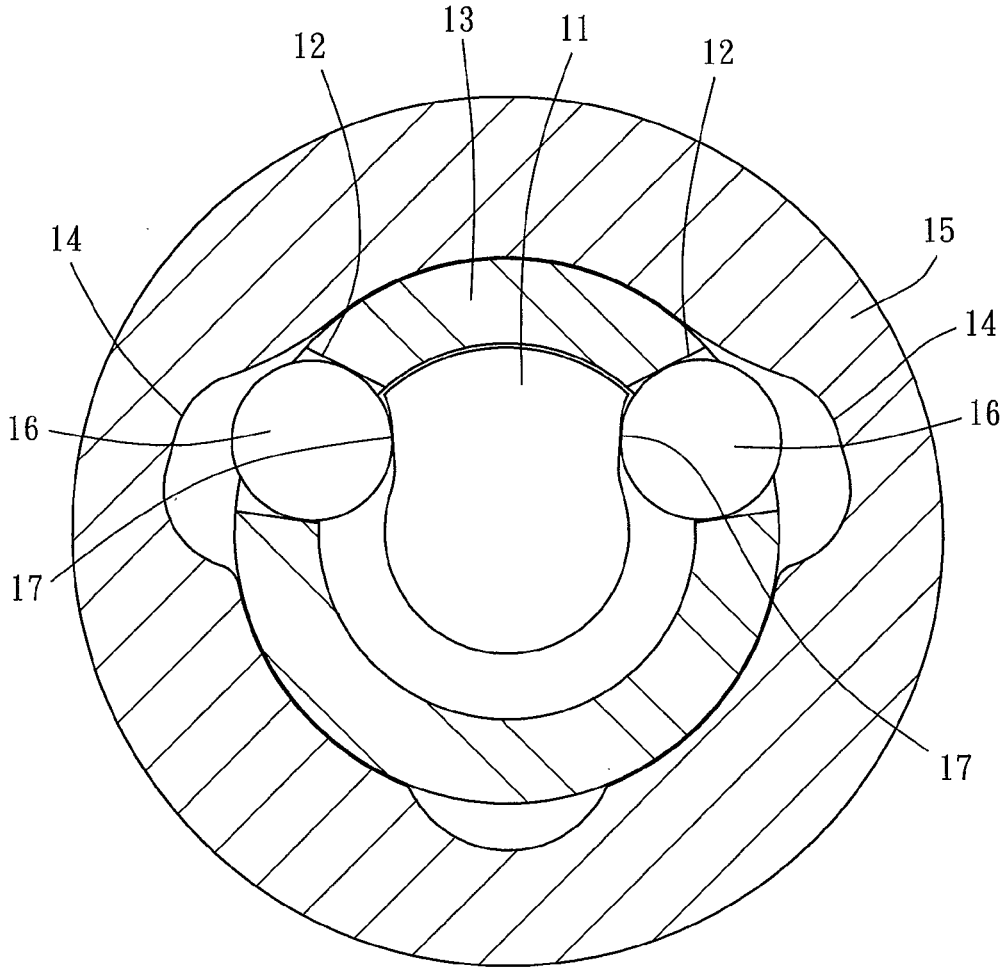
FIG. 2 PRIOR ART
FIG. 2 is a sectional view taken along the line 2-2 in FIG. 1.
Figure 3:
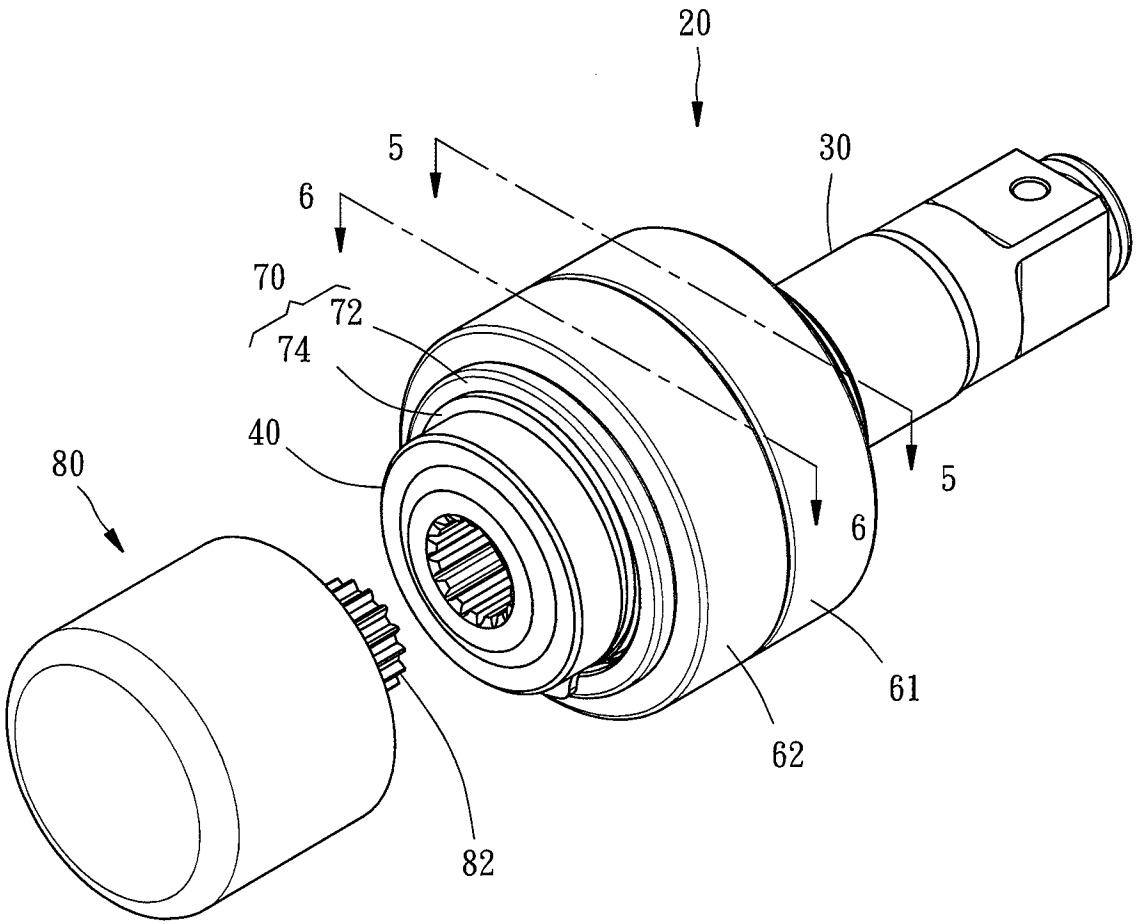
FIG. 3 is an exploded perspective view showing an impact device and a pneumatic motor of a pneumatic tool according to a first preferred embodiment of the present invention.

First of all, it is to be mentioned that same reference numerals used in the following preferred embodiments and the appendix drawings designate same or similar elements throughout the specification for the purpose of concise illustration of the present invention.

Referring to FIGS. 3-6, an impact device 20 of a pneumatic tool according to a first preferred embodiment of the present invention comprises a transmission shaft 30, an impact cylinder 40, two first impact pins 51A, 51B, two second impact pins 52A, 52B, a first ring 61, a second ring 62, and two limiting units 70.

The transmission shaft 30 has an impacted section 31, and an extending section 32 extending from the impacted section 31 along an axis L of the transmission shaft 30. The extending section 32 has a sleeved portion 322 approximately shaped as a square column for connection with a socket (not shown), which is configured corresponding in shape to a screw or a nut (not shown), so that the socket is driven by the transmission shaft 30 so as to further drive the screw or nut to rotate when the transmission shaft 30 rotates.

The transmission shaft 30 further has a first protrusion 33 extending from the impacted section 31 toward a first radial direction D1 of the transmission shaft 30, two first concave surfaces 34A, 34B located at two sides of the first protrusion 33, a second protrusion 35 extending from the impacted section 31 toward a second radial direction D2 of the transmission shaft 30, which is inverse to the first radial direction D1, and two second concave surfaces 36A, 36B located at two sides of the second protrusion 35.

The impact cylinder 40 is centrally empty from one end to the other and provided at the inside thereof with a passage 41 for accommodating the impacted section 31 of the transmission shaft 30, and at an end of the passage 41 with an inner gear portion 42 for connection with an output shaft 82 of a pneumatic motor 80, so that the impact cylinder 40 can be driven by the pneumatic motor 80 to rotate about the axis L. The impact cylinder 40 is provided at the outside thereof with two elongated protrusions 43, 44 which are located at two opposite sides of the impact cylinder 40, i.e. the upside and the downside in FIGS. 4-6, and extending parallel to the axis L of the transmission shaft 30.

Figure 4:
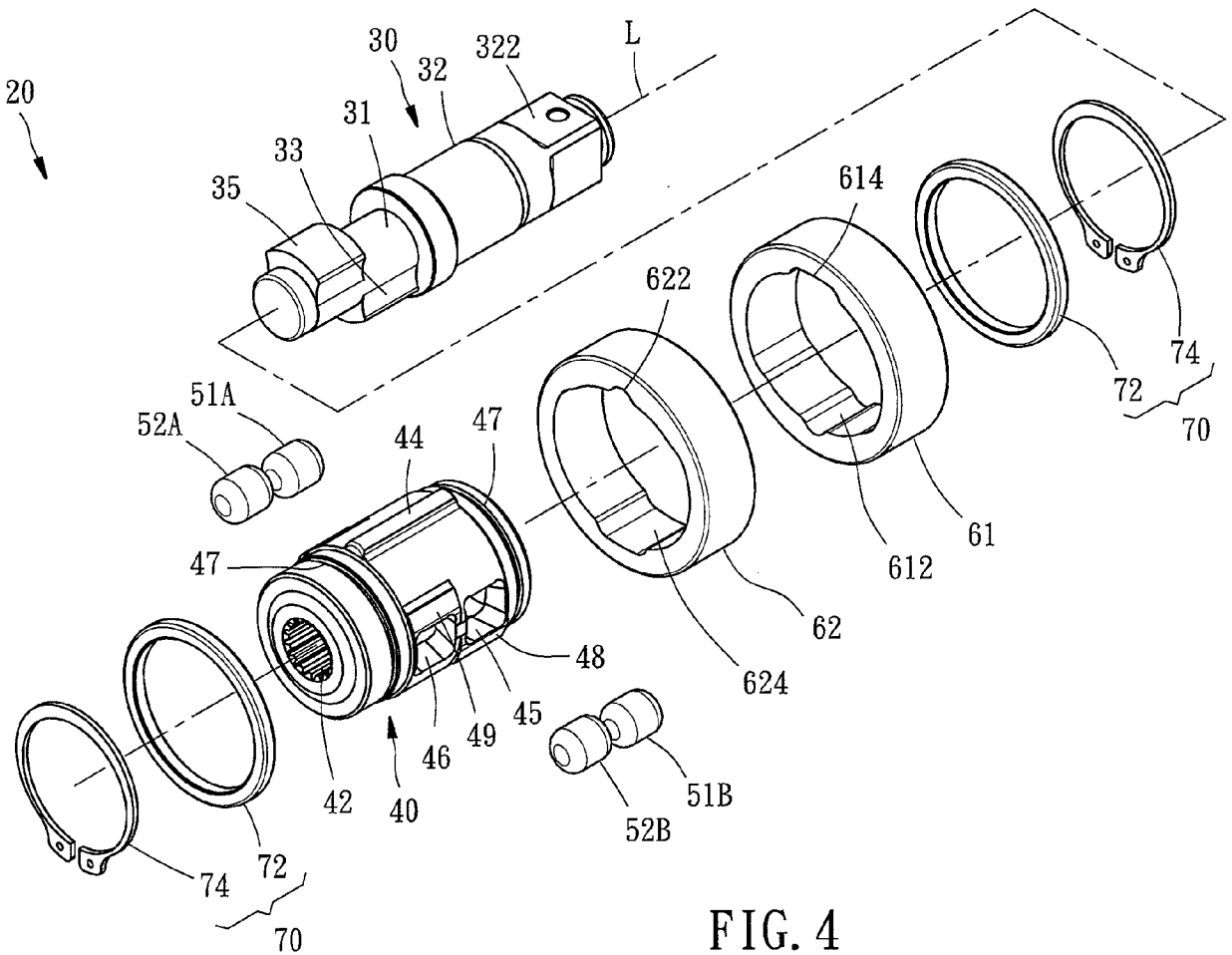
FIG. 4 is an exploded perspective view of the impact device according to the first preferred embodiment of the present invention.
Figure 5:
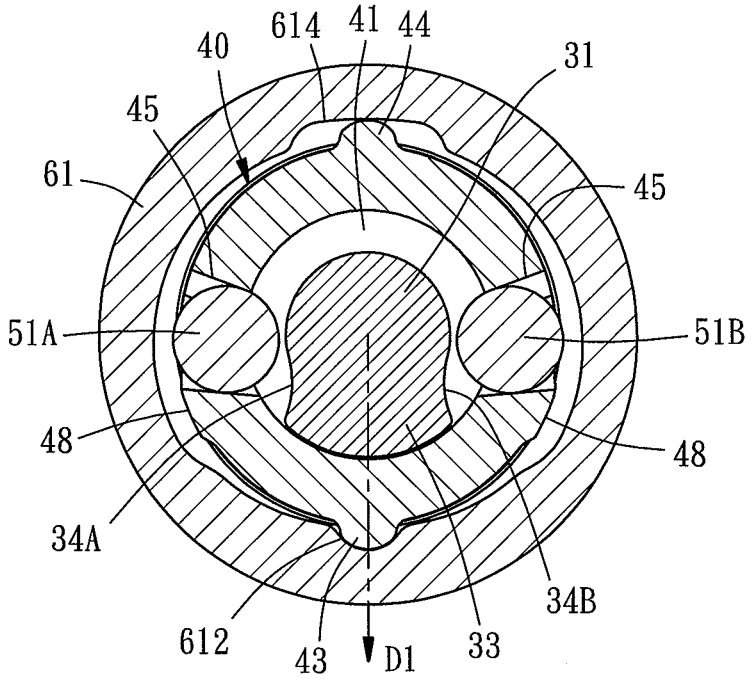
FIG. 5 and FIG. 6 are sectional views taken along the lines 5-5 and 6-6 in FIG. 3, respectively.
Figure 6:
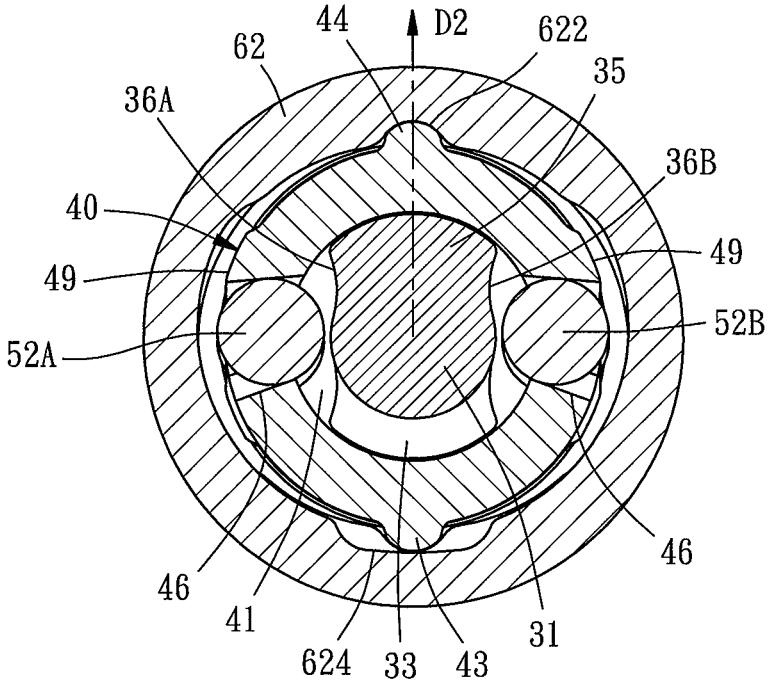

The impact cylinder 40 is provided at two other opposite sides thereof, i.e. the left side and the right side in FIGS. 4-6, with two first radial holes 45 and two second radial holes 46. As shown in FIG. 5, the first radial holes 45 and the elongated protrusions 43, 44 are alternately arranged along the circumference of the impact cylinder 40. As shown in FIG. 6, the second radial holes 46 and the elongated protrusions 43, 44 are alternately arranged along the circumference of the impact cylinder 40. In addition, the impact cylinder 40 is provided at the outside thereof with two grooves 47. The elongated protrusions 43, 44 and the first and second radial holes 45, 46 are located between the grooves 47.

The first impact pins 51A, 51B are located in the first radial holes 45, respectively. The first ring 61 is sleeved onto the impact cylinder 40 and the first impact pins 51A, 51B so as to prevent the first impact pins 51A, 51B from escape from the first radial holes 45. The second impact pins 52A, 52B are located in the second radial holes 46, respectively. The second ring 62 is disposed in alignment with the first ring 61 and sleeved onto the impact cylinder 40 and the second impact pins 52A, 52B so as to prevent the second impact pins 52A, 52B from escape from the second radial holes 46. The first impact pins 51A, 51B and the second impact pins 52A, 52B are shaped as circular columns extending parallel to the axis L of the transmission shaft 30.

The first ring 61 is provided at the inside thereof with a first narrow groove 612 and a first wide groove 614 wider than the first narrow groove 612. The second ring 62 is provided at the inside thereof with a second narrow groove 622 and a second wide groove 624 wider than the second narrow groove 622. The first and second narrow grooves 612, 622 and wide grooves 614, 624 all extend parallel to the axis L of the transmission shaft 30. In fact, the first and second rings 61, 62 are the same in shape, but arranged having a phase difference of 180 degrees in orientation when being sleeved onto the impact cylinder 40. That is, the first wide groove 614 and the second narrow groove 622 are aligned with respect to each other and both located at the upside of the impact cylinder 40 in FIGS. 5-6; the first narrow groove 612 and the second wide groove 624 are aligned with respect to each other and both located at the downside of the impact cylinder 40 in FIGS. 5-6. Besides, the elongated protrusions 43, 44 are restrictedly located in the first narrow groove 612 and the second narrow groove 622 respectively, and movably located in the second wide groove 624 and the first wide groove 614, respectively.

Each limiting unit 70 comprises a limiting ring 72 and a retaining ring 74. The limiting rings 72 are sleeved onto the impact cylinder 40. The first and second rings 61, 62 are located between the limiting rings 72. The retaining rings 74 are embedded in the grooves 47 respectively so that the limiting rings 72 and the first and second rings 61, 62 are limited between the retaining rings 74 and therefore prevented from separation from the impact cylinder 40.

The working process of the impact device 20 will be specified in the following contents wherein the situation that the impact cylinder 40 is driven by the pneumatic motor 80 to rotate counterclockwise is instanced and the positional variations of the first impact pins 51A, 51B and the first ring 61 resulted from the driving of the impact cylinder 40 are described in coordination with FIGS. 7-14. The positional variations of the second impact pins 52A, 52B and the second ring 62 will not be illustrated in the following contents and the figures because they are similar to the positional variations of the first impact pins 51A, 51B and the first ring 61, but having a phase difference of 180 degrees in orientation.

Figure 7:
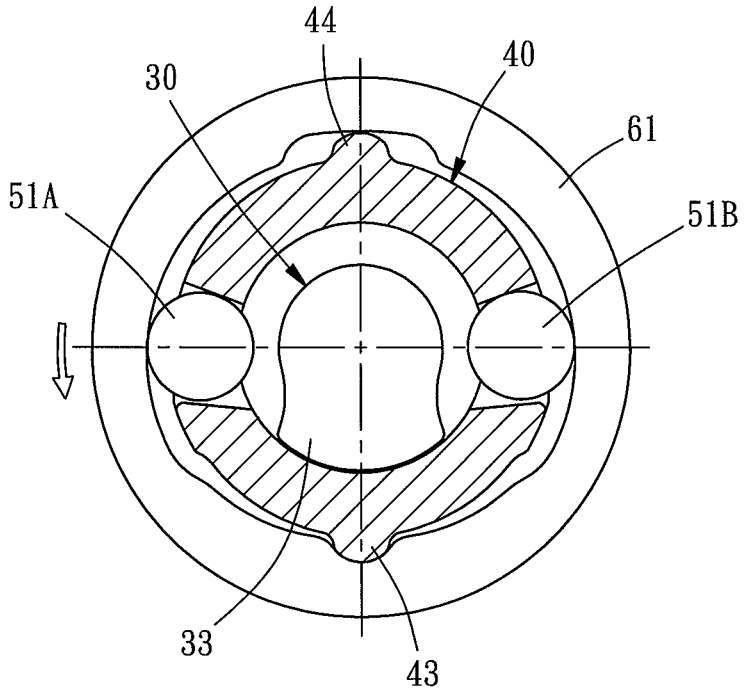
FIGS. 7-14 are similar to FIG. 5, but showing the working process of the impact device upon producing impacts.
Figure 8:
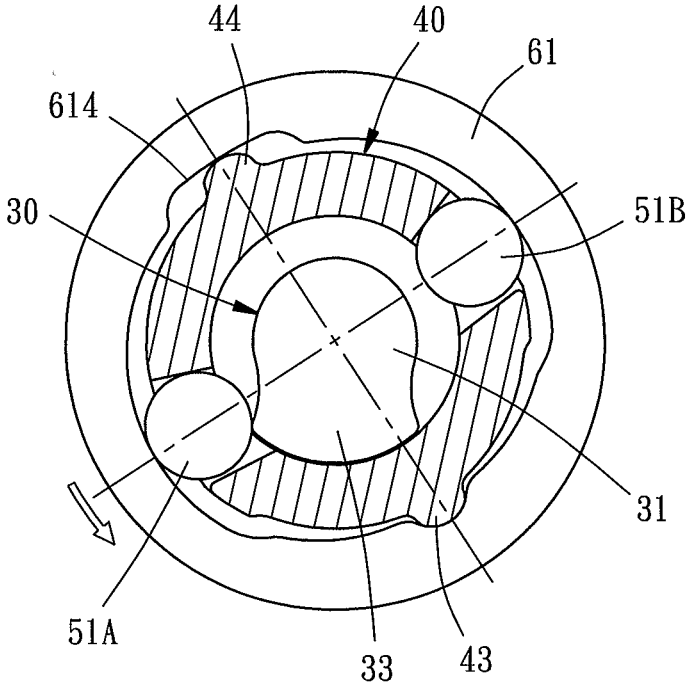
Figure 9:
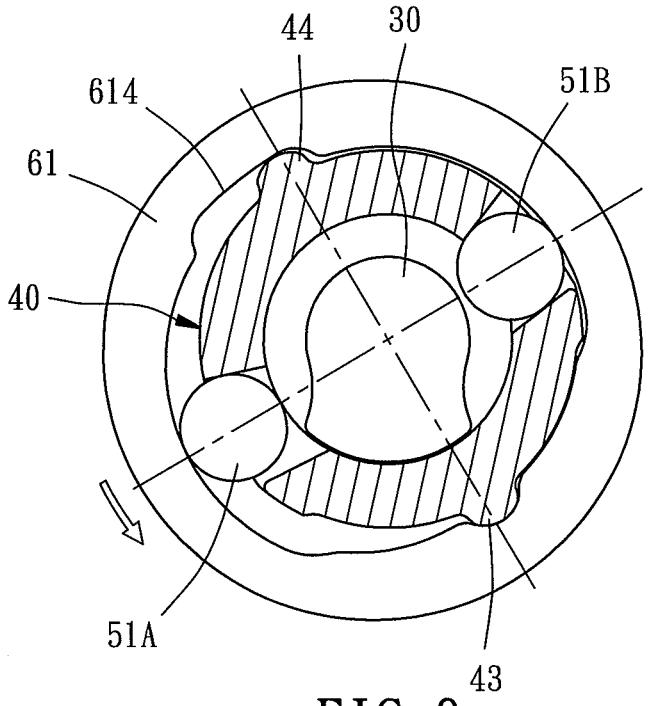
Figure 10:
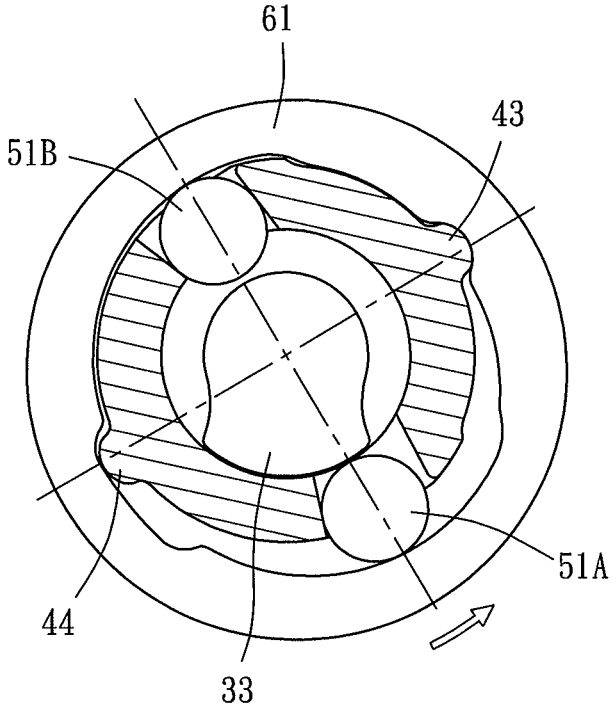
Figure 11:
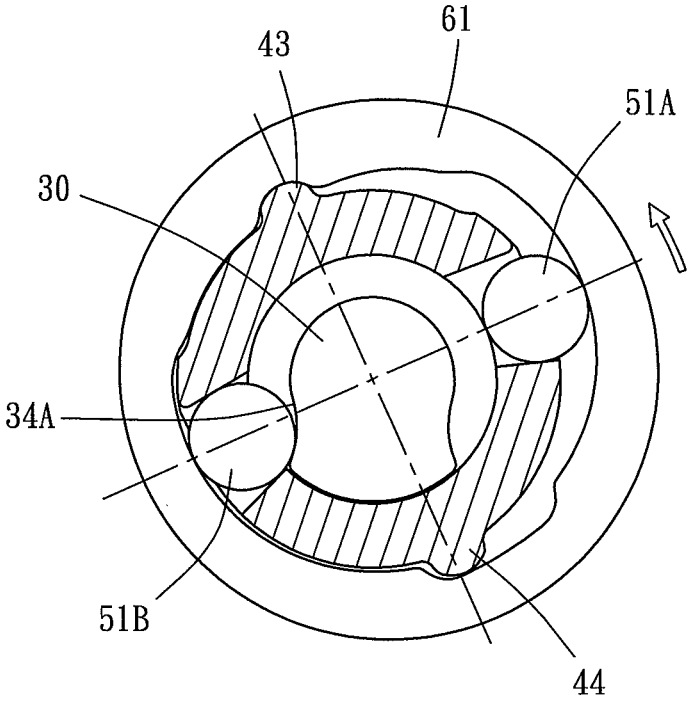

As shown in FIGS. 7-8, when the impact cylinder 40 rotates, the first ring 61 is rotationally driven by the elongated protrusion 43; in the meanwhile, the first impact pins 51A, 51B are also driven by the impact cylinder 40 to rollingly orbit about the transmission shaft 30. Besides, when the first impact pin 51A is abutted against the first protrusion 33, the transmission shaft 30 is rotationally driven by the first impact pin 51A. However, if the transmission shaft 30 is loaded too much to be driven by the first impact pin 51A, the first ring 61 is driven to swing to the left relative to the impact cylinder 40 and the transmission shaft 30, as shown in FIG. 9; at the same time, the elongated protrusion 44 of the impact cylinder 40 moves to the right in the first wide groove 614. In the meanwhile, the second ring 62 is driven to swing to the right relative to the impact cylinder 40 and the transmission shaft 30. As a result, the first impact pin 51B is pushed by the first ring 61 and thereby moves toward the transmission shaft 30, and the first impact pin 51A is movable away from the transmission shaft 30 so as to slide over the first protrusion 33 and continue to orbit about the transmission shaft 30, as shown in FIG. 10.

Figure 12:
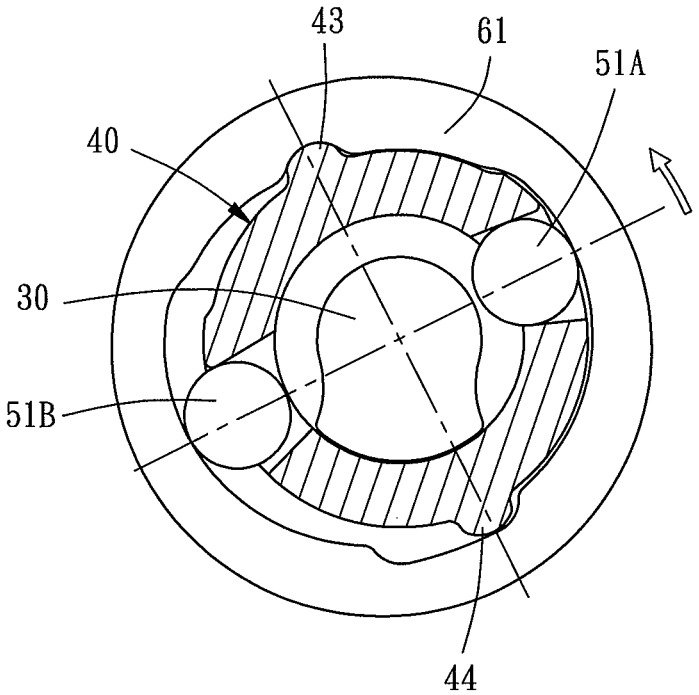
Figure 13:
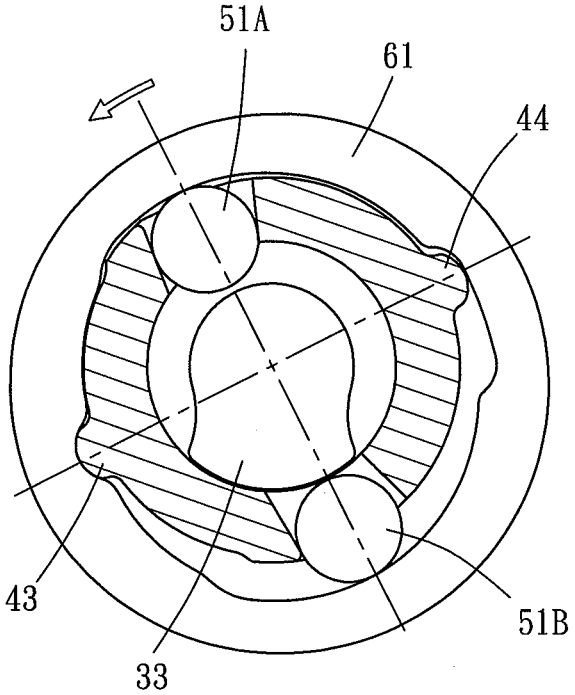
Figure 14:
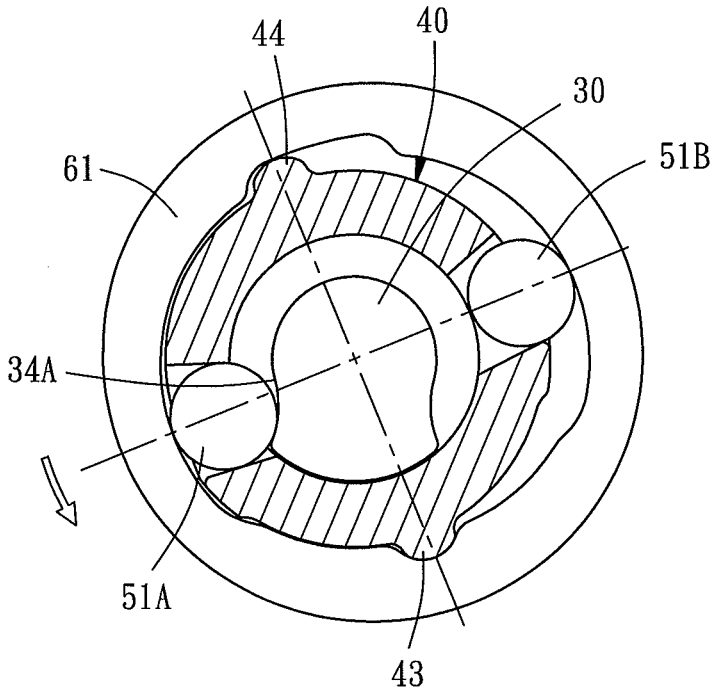

The first impact pin 51B is continuously pressed by the first ring 61 after the step shown in FIG. 9 and orbits about the transmission shaft 30 at the same time. Therefore, the first impact pin 51B is driven to impact the first concave surface 34A of the transmission shaft 30 when orbiting to the position shown in FIG. 11. The rotational momentum of the impact cylinder 40 and the first ring 61 is transmitted to the transmission shaft 30 by the first impact pin 51B at the moment that the transmission shaft 30 is impacted by the first impact pin 51B. At this time, the first ring 61 is driven to swing to the left relative to the impact cylinder 40 and the transmission shaft 30, as shown in FIG. 12. In the meanwhile, the second ring 62 is driven to swing to the right relative to the impact cylinder 40 and the transmission shaft 30. As a result, the first impact pin 51A is pushed by the first ring 61 and thereby moves toward the transmission shaft 30, and the first impact pin 51B is movable away from the transmission shaft 30 so as to slide over the first protrusion 33 and continue to orbit about the transmission shaft 30, as shown in FIG. 13.

The first impact pin 51A is continuously pressed by the first ring 61 after the step shown in FIG. 12 and orbits about the transmission shaft 30 at the same time. Therefore, the first impact pin 51A is driven to impact the first concave surface 34A of the transmission shaft 30 when orbiting to the position shown in FIG. 14. The rotational momentum of the impact cylinder 40 and the first ring 61 is transmitted to the transmission shaft 30 by the first impact pin 51A at the moment that the transmission shaft 30 is impacted by the first impact pin 51A. At this time, the first ring 61 is driven to swing to the left relative to the impact cylinder 40 and the transmission shaft 30, and the second ring 62 is driven to swing to the right relative to the impact cylinder 40 and the transmission shaft 30, so that the impact device 20 becomes the status shown in FIG. 9 again. In this way, as long as the pneumatic motor 80 continuously drives the impact cylinder 40 to rotate, the impact device 20 will repeat the aforesaid working process continuously; which means, each of the first impact pins 51A, 51B will be driven to impact the first concave surface 34A of the transmission shaft 30 once in every cycle. Besides, when the first concave surface 34A is impacted by the first impact pin 51B, the second concave surface 36B of the transmission shaft 30 is impacted by the second impact pin 52A; when the first concave surface 34A is impacted by the first impact pin 51A, the second concave surface 36B of the transmission shaft 30 is impacted by the second impact pin 52B. Repeating the working process will drive the transmission shaft 30 to rotate at the moments of being impacted and thereby loosen the screw or nut. Because the second ring 62 is driven to swing to the right when the first ring 61 is driven to swing to the left, the swinging forces of the first and second rings 61, 62 are counteracted by each other so that the transmission shaft 30 and the impact cylinder 40 are prevented from vibration resulted from radial forces.

The impact device 20 can be driven to rotate clockwise and therefore perform a similar process to the aforesaid process. However, when the impact device 20 is driven to rotate clockwise, the first impact pins 51A, 51B are driven to impact the first concave surface 34B of the transmission shaft 30 intermittently, and the second impact pins 52A, 52B are driven to impact the second concave surface 36A of the transmission shaft 30 intermittently.

It is to be mentioned that the impact cylinder 40 in the aforesaid embodiment is provided at the outside thereof with two convex portions 48 located by the first radial holes 45 respectively, and two convex portions 49 located by the second radial holes 46 respectively. The convex portions 48, 49 can increase the structural strength of the impact cylinder 40, the impact forces received by the transmission shaft 30 from the first and second impact pins 51A, 51B, 52A, 52B, and the lifetime of the impact device 20. However, the impact cylinder 40 can be provided without such convex portions 48, 49.

Besides, the transmission shaft 30 can be provided without such second protrusion 35; in this condition, the impact cylinder 40 can be provided without such second radial holes 46, and the impact device 20 has no such second impact pins 52A, 52B and second ring 62. This design is similar to the impact device in the following second preferred embodiment of the present invention. However, in the aforesaid first preferred embodiment, the swinging forces from the first and second rings to reverse directions are received by the transmission shaft 30 at the same time so that the impact device 20 has relatively less vibration resulted from the swinging force when operating.

Figure 15:
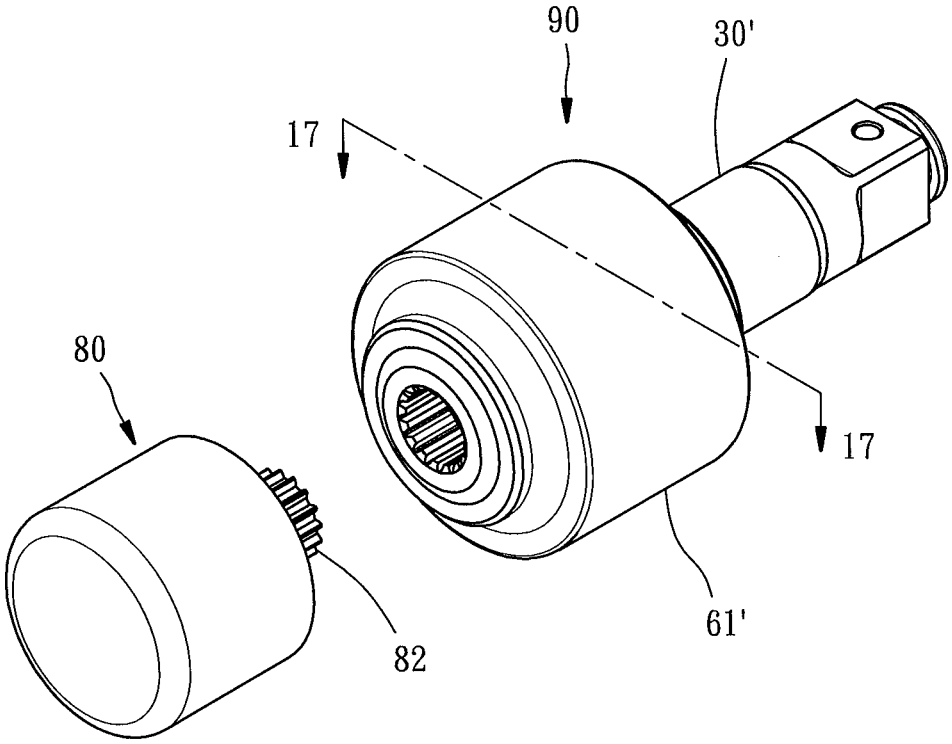
FIG. 15 is an exploded perspective view showing an impact device and a pneumatic motor of a pneumatic tool according to a second preferred embodiment of the present invention.
Figure 16:
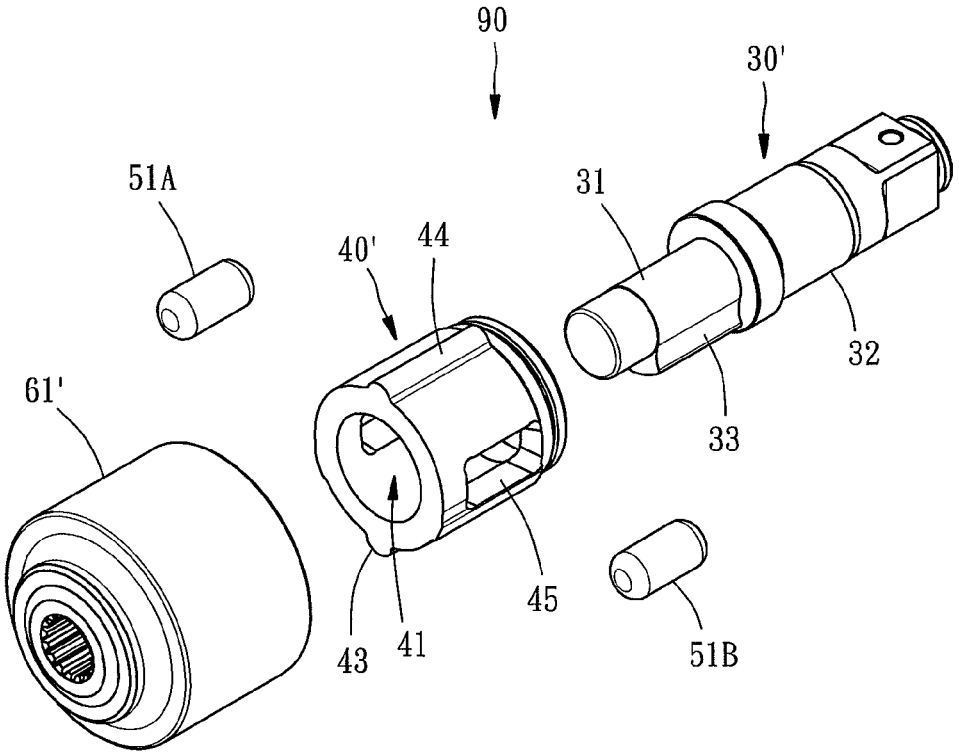
FIG. 16 is an exploded perspective view of the impact device according to the second preferred embodiment of the present invention.
Figure 17:
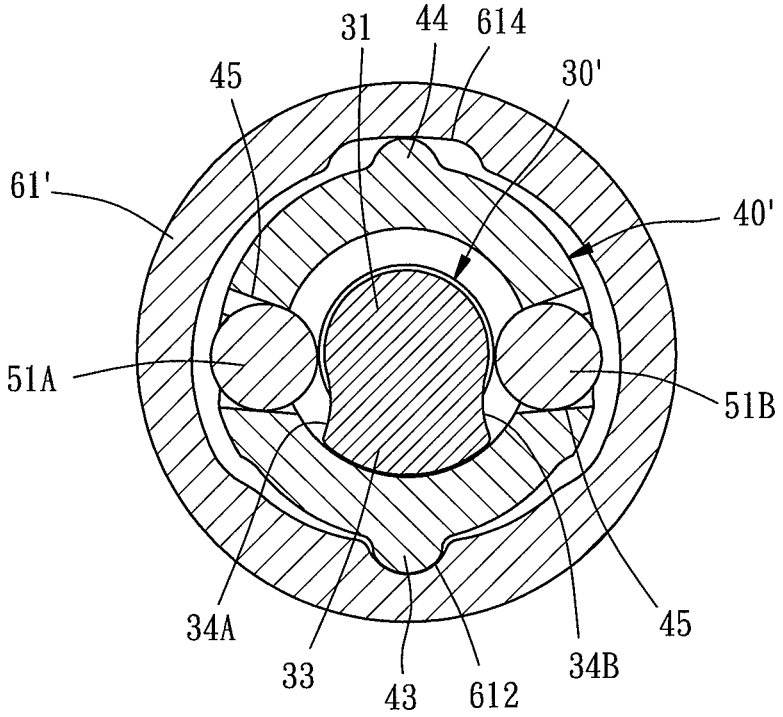
FIG. 17 is a sectional view taken along the line 17-17 in FIG. 15.

Referring to FIGS. 15-17, an impact device 90 of a pneumatic tool according to the second preferred embodiment of the present invention comprises a transmission shaft 30', an impact cylinder 40', two first impact pins 51A, 51B, and a first ring 61'. The impact device 90 is similar to the aforesaid impact device 20 in structure, but has no such second protrusion 35, second radial holes 46, second impact pins 52A, 52B and second ring 62, and the first ring 61' is rotationally driven by the pneumatic motor 80 so that the whole impact device 90 is driven to rotate to perform the operating process as shown in FIGS. 7-14.

What is claimed is:

1. An impact device comprising:

a transmission shaft which has an impacted section, an extending section extending from the impacted section along an axis of the transmission shaft, a first protrusion extending from the impacted section toward a first radial direction, and two first concave surfaces located at two sides of the first protrusion;

an impact cylinder which is provided at an inside thereof with a passage for accommodating the impacted section of the transmission shaft, at an outside thereof with two elongated protrusions which are located at two opposite sides of the impact cylinder and extend parallel to the axis, and at two other opposite sides thereof with two first radial holes, the two first radial holes and the two elongated protrusions being alternately arranged along a circumference of the impact cylinder;

two first impact pins which are respectively received in the first radial holes, shaped as circular columns extending parallel to the axis of the transmission shaft, and abuttable against the first concave surfaces of the transmission shaft; and a first ring which is sleeved onto the impact cylinder and the first impact pins, and provided at an inside thereof with a first narrow groove and a first wide groove both extending parallel to the axis of the transmission shaft, wherein the first wide groove is wider than the first narrow groove; one of the elongated protrusions is located in the first narrow groove and the other elongated protrusion is movably located in the first wide groove.

2. The impact device as claimed in claim 1, wherein the transmission shaft comprises a second protrusion extending from the impacted section toward a second radial direction which is reverse to the first radial direction, and two second concave surfaces located at two sides of the second protrusion; the impact cylinder is further provided at two opposite sides thereof with two second radial holes; the two second radial holes and the two elongated protrusions are alternately arranged along the circumference of the impact cylinder; the impact device further comprises two second impact pins respectively received in the second radial holes, shaped as circular columns extending parallel to the axis of the transmission shaft, and abuttable against the second concave surfaces of the transmission shaft, and a second ring sleeved onto the impact cylinder and the second impact pins, aligned with the first ring, and provided at an inside thereof with a second narrow groove and a second wide groove both extending parallel to the axis of the transmission shaft; the second wide groove is wider than the second narrow groove; the second narrow groove is in alignment with the first wide groove; the second wide groove is in alignment with the first narrow groove; one of the elongated protrusions is located in the second narrow groove; the other elongated protrusion is movably located in the second wide groove.

3. The impact device as claimed in claim 1, wherein the impact cylinder is adapted to be driven by a pneumatic motor to rotate.

4. The impact device as claimed in claim 1, wherein the first ring is adapted to be driven by a pneumatic motor to rotate.

5. The impact device as claimed in claim 1, wherein the impact cylinder is provided at the outside thereof with two convex portions located by the first radial holes.

* * * * *